US009545656B2

(12) United States Patent
Aldred et al.

(10) Patent No.: US 9,545,656 B2
(45) Date of Patent: Jan. 17, 2017

(54) METHOD TO MECHANICALLY PRODUCE A REPEATABLE SEAM IN A CAN

(71) Applicant: WILD GOOSE ENGINEERING, LLC, Boulder, CO (US)

(72) Inventors: Jeff Aldred, Boulder, CO (US); Alexis S Foreman, Boulder, CO (US)

(73) Assignee: WILD GOOSE ENGINEERING, LLC, Boulder, CO (US)

( * ) Notice: Subject to any disclaimer, the term of this patent is extended or adjusted under 35 U.S.C. 154(b) by 806 days.

(21) Appl. No.: 13/666,172

(22) Filed: Nov. 1, 2012

(65) Prior Publication Data

US 2013/0108399 A1 May 2, 2013

Related U.S. Application Data

(60) Provisional application No. 61/554,025, filed on Nov. 1, 2011.

(51) Int. Cl.
*B21D 51/26* (2006.01)
*B21D 51/32* (2006.01)

(52) U.S. Cl.
CPC ..... *B21D 51/32* (2013.01); *B21D 51/2653* (2013.01); *B21D 51/26* (2013.01); *B21D 51/2615* (2013.01); *B21D 51/2661* (2013.01)

(58) Field of Classification Search
CPC ..... B21D 51/30; B21D 51/26; B21D 51/2653; B21D 51/2615; B21D 51/2623; B21D 51/263; B21D 51/2638; B21D 51/2661; B21D 51/32; B21D 51/34
USPC ..... 413/6, 31–33, 40, 41
See application file for complete search history.

(56) References Cited

U.S. PATENT DOCUMENTS 4,004,529 A * 1/1977 Grotnes ..... 413/31
4,218,983 A * 8/1980 Rhinefrank et al. ..... 413/75
4,513,487 A * 4/1985 Binnie ..... B21D 39/02 29/243.5
5,074,034 A * 12/1991 Lebbon ..... 29/806
(Continued)

FOREIGN PATENT DOCUMENTS

EP 1055469 11/2000
EP 1230999 A1 8/2002
(Continued)

OTHER PUBLICATIONS

Extended European Search Report mailed Apr. 17, 2015 for corresponding EP Application No. 12846243.9.
(Continued)

*Primary Examiner* — Jimmy T Nguyen
*Assistant Examiner* — Gregory Swiatocha
(74) *Attorney, Agent, or Firm* — Swanson & Bratschun, L.L.C.

(57) ABSTRACT

A can seaming apparatus and methods of forming a seam on a can and lid assembly is disclosed. The apparatus includes one or more seaming arms pivotably attached to a shaft, a seam roller attached to one end of each seaming arm and a cam system. The cam system includes one or more cams associated with the end of each seaming arm opposite the seam roller. Force is transferred to each seaming arm through rotation of the one or more cams. The seaming arm then pivots and moves the associated roller into a seaming area of a can and lid assembly to create a seam.

12 Claims, 9 Drawing Sheets

(56) References Cited

U.S. PATENT DOCUMENTS

| | | | | |
|---|---|---|---|---|
| 6,623,230 | B1 * | 9/2003 | Bagheri et al. | 413/4 |
| 6,890,140 | B2 * | 5/2005 | Egerton et al. | 413/4 |
| 2004/0197164 | A1 | 10/2004 | Carrein et al. | |
| 2007/0248437 | A1 | 10/2007 | Rudd et al. | |
| 2009/0200321 | A1 | 8/2009 | Oohori et al. | |

FOREIGN PATENT DOCUMENTS

| | | |
|---|---|---|
| JP | 07-039972 | 2/1995 |
| JP | 08-168837 | 7/1996 |

OTHER PUBLICATIONS

International Search Report and Written Opinion for PCT/US2012/062946, Mailed Mar. 21, 2013.

* cited by examiner

METHOD TO MECHANICALLY PRODUCE A REPEATABLE SEAM IN A CAN

TECHNICAL FIELD

The present disclosure is directed to systems and methods for the production of seams to seal lids onto cans, particularly seaming metal lids and cans in the food and beverage industries.

BACKGROUND

A variety of can seaming apparatus are presently available for seaming lids onto metal cans in the food and beverage industries. Particularly for smaller cans with smaller lids, pneumatic sealing devices are preferable in terms of cost reduction and setup time. However, one existing difficulty in devices using air pressure to drive pivoting arms equipped with seam rollers into a can seaming area is in maintaining the high accuracy necessary to drive the roller into the correct position at the seaming area to produce a sufficient seam.

Typically, an air cylinder drives the seam roller into the seaming area. However, maintaining a consistent dimensional deformation throughout the seaming area is difficult to achieve with air cylinders in conventional designs. Existing methods use a sequence of two seam rollers to form the lips of the lid and the can into the required seal. Low pressure in the air system driving the seam rollers or an inadequate dwell time in the seaming process lead to discontinuity in the seam area. This causes dimensional variations in the seam area. Additionally, if the seam producing rollers travel too far into the seam forming area or not far enough, an inadequate seam is formed. These inaccuracies frequently lead to leakage and contamination of contents within the can. Such cans are not acceptable for further processing or sale, which leads to inefficiencies in the canning process and production of canned foods and beverages.

The repeatable seam apparatus disclosed herein is intended to overcome one or more of the problems discussed above.

SUMMARY OF THE EMBODIMENTS

One embodiment disclosed herein is a can seaming apparatus that includes a seaming arm pivotably attached to a shaft of the can seaming device. A seam roller is attached to one end of the seaming arm, and a cam system is attached to the other end of the seaming arm distal to the seam roller.

The cam system of the can seaming apparatus may include a rotating cam, a cam follower and an actuator. The actuator may rotate the cam about an axis, with the rotating cam providing a force on the cam follower that is in mechanical contact with the perimeter of the rotating cam. The cam follower may be operatively attached to an end of the seaming arm distal the seam roller. The force provided to the cam follower may be transferred to the seaming arm through direct contact, and therefore pivoting the seaming arm about the shaft of the can seaming device. The pivot force provided at one end of the seaming arm may swing the other end of the seaming arm, containing the seam roller, into a seaming area of a can and lid assembly.

In an embodiment which features an actuator in the cam system, the actuator may be a pneumatic actuation device. In other embodiments, the actuator may be an electric motor or a programmable controller.

Similarly, the cam follower may be an eccentric cam follower, thus allowing for fine tune adjustments to the cam system driving the seaming arms and seam rollers of the can producing apparatus. This may allow for smooth and repeatable can seaming operation.

Furthermore, the cam system may include a separate single-lobed rotating cam for each actuation device. In some embodiments, the can seaming apparatus may include a plurality of seam rollers. In this representative embodiment, the can seaming apparatus may further include multiple seaming arms. As such, the cam system of the can seaming apparatus might include a rotating cam with two or more lobes. The number of lobes may correspond to the number of seam rollers in operation of the can seaming apparatus.

The can seaming apparatus may include a height adjustment device attached to the seaming arm. This may provide for adjustment of the vertical positioning of the seam roller. In some cases, this height adjustment device may be a manually turnable knob, where turning the knob in either direction may cause the seam roller to be positioned higher or lower on its vertical axis. The height of the seam roller may be specified according to industry standards for producing acceptable can seams. The height adjustment device may allow for easy adjusting, and therefore repeatable fine tune adjustments of the positioning of the seam roller into a proper seam area of the can and lid assembly. This particular embodiment may contribute to producing repeatable and highly accurate can seams with the can seaming apparatus. The cam seaming device may further include a can lifting device to lift a can and lid assembly into contact with the seaming chuck.

It may be desirable for specific embodiments that the bearing of the rotating cam is aligned with the rotational axis of the can and lid assembly. In other embodiments, the bearing of the cam may rotate at an axis that is offset from the rotational axis of the can and lid assembly.

Another embodiment disclosed herein is a method of producing a seam on a can and lid assembly. The method includes providing a seam roller that is attached to one end of a seaming arm. The seaming arm may be pivotably secured to a shaft. A cam system may be provided, and may include a rotating cam that is mechanically associated with a cam follower and an actuator. The cam system may be operatively associated with a second end of the seaming arm that is distal to the first end containing the seam roller. The actuator may actuate the cam system to drive the rotating cam, which may provide a sliding force on the cam follower that is in contact with the perimeter of the rotating cam. This contact may transfer a force from the rotating cam to the second end of the seaming arm, which may cause a repeatable swinging motion of the seaming arm about the shaft, and therefore engage the seam roller into contact with the can and lid assembly.

As used herein, a means for actuating the cam system may include pneumatic actuation means. Alternatively, the actuating means include means for an electric motor or means for programmable controls.

The method may further include adjusting the cam system by selecting a specific eccentric cam and cam follower. This may allow for producing a highly accurate and repeatable can seam.

In other embodiments, the method may include driving a single lobe rotating cam of the cam system with an actuator. Alternatively, the method may include driving a multiple lobe rotating cam with an actuator.

A height adjustment device may allow for fine tuning of the vertical height of the seam roller with respect to the can and lid assembly. Such positioning of the seam roller may be specified by industry standards, and furthermore may be easily adjusted with the height adjustment device, therefore allowing the user to produce accurate and repeatable can seams.

The method may further include rotating the cam around the rotational axis of the can and lid assembly. In another embodiment, the method may include rotating the cam at an axis that is offset from the rotational axis of the can and lid assembly.

DETAILED DESCRIPTION

Unless otherwise indicated, all numbers expressing quantities of ingredients, dimensions, reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Figure 1:
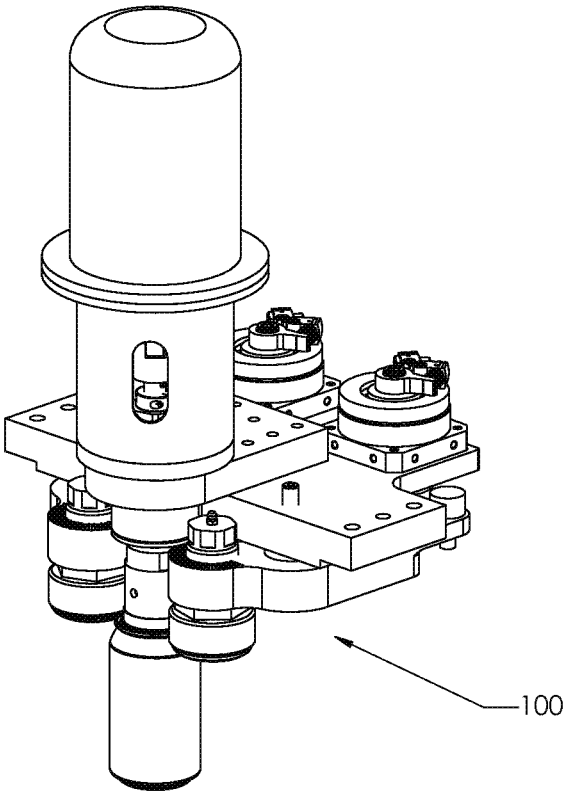
FIG. 1 is a perspective view of a can seaming apparatus as disclosed herein.

FIG. 1 illustrates one embodiment of a can seaming apparatus 100. The FIG. 1 embodiment features a pneumatically actuated cam that can be deployed against a pivoting arm equipped with a specialized roller to repeatedly produce a pressure tight seam in a can. Particularly, the disclosed can seam producing device uses both a highly accurate cam system and a linearly actuated slide, pneumatically driven or otherwise, to deploy the cams. The various embodiments feature a metal cam with an adjustable cam follower in order to achieve precise dimensional control in the seaming process. An adjustment feature on the cam follower enables an operator to finely tune the engagement of both seaming rollers, producing a controllable seam between the can and the lid. The disclosed systems can be retrofitted on existing pneumatic only driven can sealers. The described systems can also operate as a standalone can sealing device.

Figure 2:
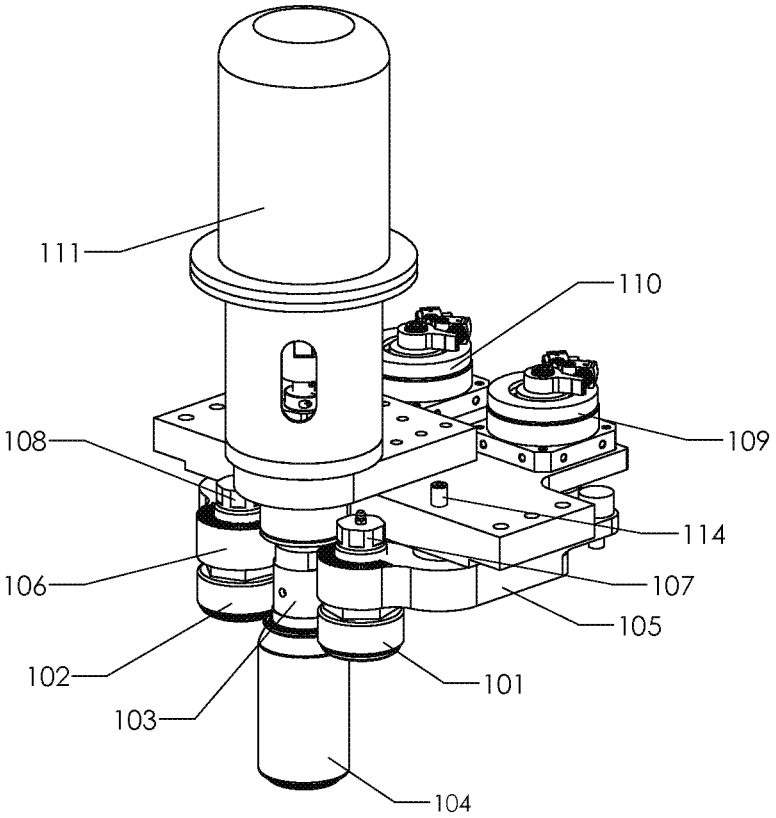
FIG. 2 is a perspective view of several components of a can seaming apparatus from an upper point of view.

FIG. 2 is a perspective view from an upper vantage point of the seam producing device 100. In use, a can and lid assembly 104 to be seamed is brought into contact with a seaming chuck 103. The seaming chuck 103 includes apparatus configured to secure the can and lid assembly 104 in an operative position with respect to the seam producing device 100. A motor 111 spins a shaft connected to the seaming chuck 103 at a sufficient speed to accomplish a selected number of complete revolutions in a given time frame, as required for the fabrication of an acceptable seam. The can/lid assembly 104 is held in place by the seaming chuck 103 and rotates with the motor-driven shaft of the seaming chuck 103. As both the can/lid assembly 104 and seaming chuck 103 are rotating, seam rollers 101 and 102 are brought into the area of the can/lid assembly 104 where a seam is to be formed. Formation of the can seam is accomplished in two operations. Separate rollers are therefore required. In the first operation the first seam roller engages the lip of the can and the curled outer section of the can lid and initiates the seaming process by forming the can and lid into a mutually engaged curl. The second operation involves a second roller with a different form that finishes a double envelopment seam by forming the results of the first operation into a tightly compressed band with overlapping metal from both the can and the lid. When properly aligned, the above processes form a permanent hermetic seal.

Height adjustment devices 107, 108 are threaded and fit into a likewise threaded portion of the seaming arms 105, 106. The height adjustment devices 107, 108 provide for the height of the seam rollers 101, 102 to be very accurately oriented vertically with respect to the chuck 103 and can/lid assembly 104. The seaming arms 105,106 can be rotated about pivots 114, 115 (hidden). Rotary actuators 109, 110 are located at the far end of the seaming arms 105, 106 from the seam rollers 101, 102. The rotary actuators 109, 110, in conjunction with certain cam embodiments described in detail below, drive the seaming arms 105, 106 into and out of an operative position.

Figure 3:
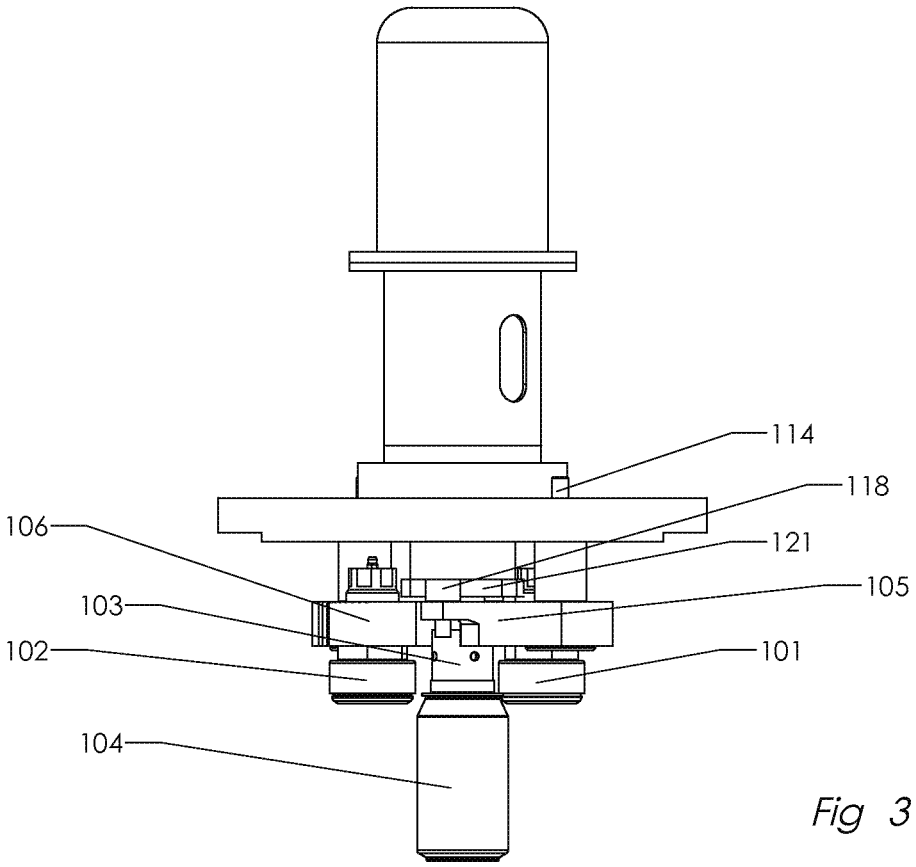
FIG. 3 is a perspective view of a seaming area for a can and lid assembly and a can seaming apparatus.

In one embodiment, a single cam rotating on its own bearing and having a cam axis coincident with the axis of the can/lid assembly 104 and the seaming chuck 103, or offset a given distance from this axis, can actuate the seam rollers 101, 102 to provide an accurate seam. In a single cam embodiment the cam will have two or more lobes corresponding to the number of seam rollers 101, 102. For example, FIG. 3 illustrates the location and position of the driving cam 121 in a single cam embodiment. This cam has a center of rotation located coincident with the center of rotation of the seaming chuck 103.

In other embodiments, a separate cam with a single lobe may be provided for each separate rotary actuator 109, 110. In this alternative embodiment, each separate cam can be mounted on its own separate bearing. In either embodiment, the rotating cam or cam system is driven separately from the can rotating system and can be sequenced on command. The cam or cam system can be driven by a pneumatic device, by an electric motor device, or another commonly used actuation method. The cam or cam system may be controlled, for example, with commands from a programmable controller. As described in detail below, adjustable cam followers 117, 118 for each of the arms carrying seaming rollers 101, 102 allow an operator to precisely adjust the resulting seam to a given specification.

In the case of a pneumatically actuated cam, the cam can be deployed against a pivoting arm equipped with a specialized roller to repeatedly produce a pressure tight seal in a can. An air pressure driven slide can be actuated to bring a shaped cam into contact with a rolling element mounted on a swiveling arm. On the opposite end of the arm, a specially constructed seam roller 101,102 is brought into a fixed distance from the edge of the can/lid interface.

Figure 4:
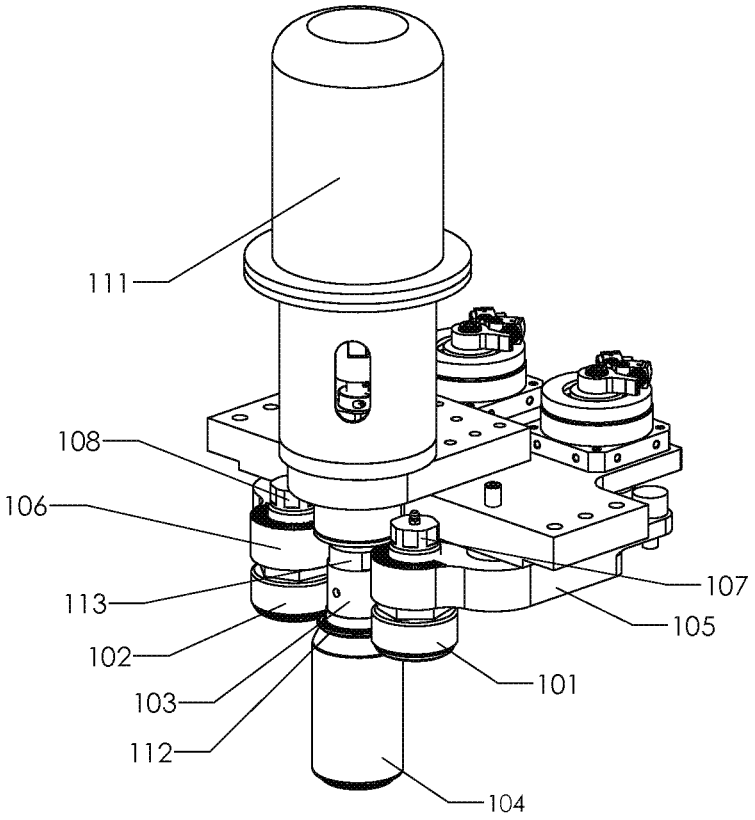
FIG. 4 is a perspective view of a seaming area for a can and lid assembly and a can seaming apparatus.

FIG. 4 is a perspective view of the seaming area. The seaming chuck 103 is attached to a shaft 113 driven by the motor 111. Seam roller 101 performs the first of two operations required to fabricate a proper seam. The seam roller 101 is brought into an accurate and repeatable position in relation to the seam area 112 of the can/lid assembly 104. Accuracy in positioning the seam roller 101 at a fixed distance from the edge of the can/lid assembly 104 is critical to the formation of a proper seam. Upon completion of the first operation, the initial seam roller 101 is retracted and the second seam roller 102 is brought into an accurate and repeatable position in relation to the seam area 112. The second seam roller has a different special construction to produce the final formation of the seam. The height adjustment devices 107, 108 control the position of their respective vertically aligned seam rollers 101, 102. Both seam rollers 101, 102 require exact dimensional control.

Figure 5:
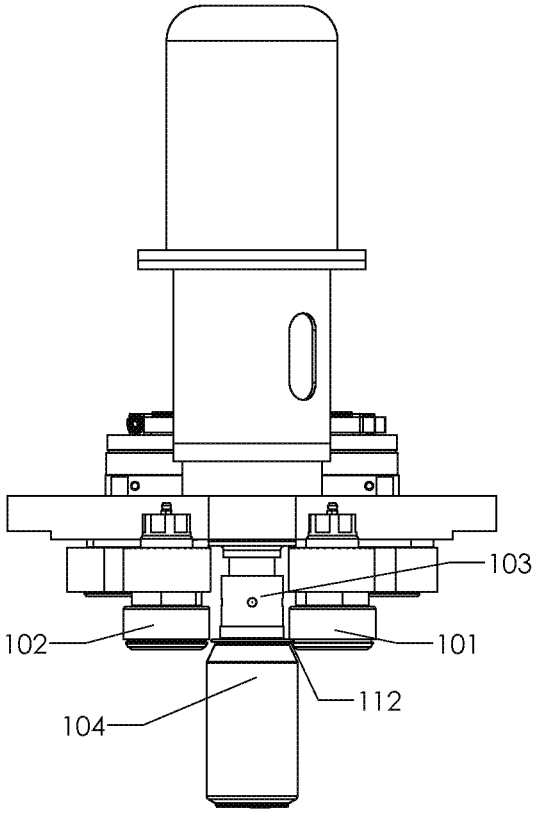
FIG. 5 is a perspective view of the engagement of a seam roller with a seaming area of a can and lid assembly.

FIG. 5 illustrates the engagement of seam roller 101 into seaming area 112. The seaming chuck 103 and can/lid assembly 104 rotate together for this first operation by seam roller 101. The seam roller 102 is disengaged, as shown by the gap between the seam roller 102 and the lip of the can/lid assembly 104.

Figure 6:
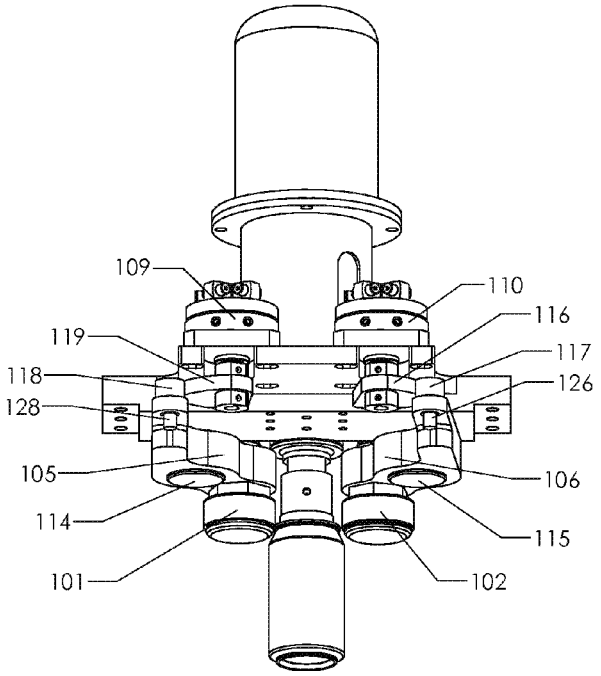
FIG. 6 is a perspective view of a cam system that drives components of the can seaming apparatus of FIG. 2.

FIG. 6 illustrates the cam system that drives the seaming arms 105, 106 in a rotating fashion to bring the seam rollers 101,102 into the desired accurate and repeatable position. In one embodiment, rotary actuators 109, 110 drive the driving cams 116, 119 in a continuous rotation. The cam followers 117, 118 in contact with the rotating driving cams 116, 119 transfer the rotary motion imparted to the cams 116, 119 by the rotary actuators 109, 110 into linear motion by pushing the seaming arms 105,106 about pivots 114, 115. Consequently, the seaming arms 105, 106 attached to the seam rollers 101, 102 push the seam rollers 101, 102 into the rotating seaming area 112. The seaming action is accomplished by deforming the can and lid interface in a controlled manner. Gross adjustment of the seam rollers 101, 102 is accomplished by loosening the rotary actuators 109, 110 and moving them in a lateral mode, thereby increasing or decreasing the relative position between seam rollers 101, 102 and the seaming area. Once gross adjustment is completed, the rotary actuators 109, 110 are re-tightened. The cam followers 117, 118 have eccentric base mounts 126, 128, allowing for fine adjustment of the relative position between the seam rollers 101,102 and the seaming area 112. Such adjustments are made in anticipation of conforming to well-established industry parameters.

Figure 7:
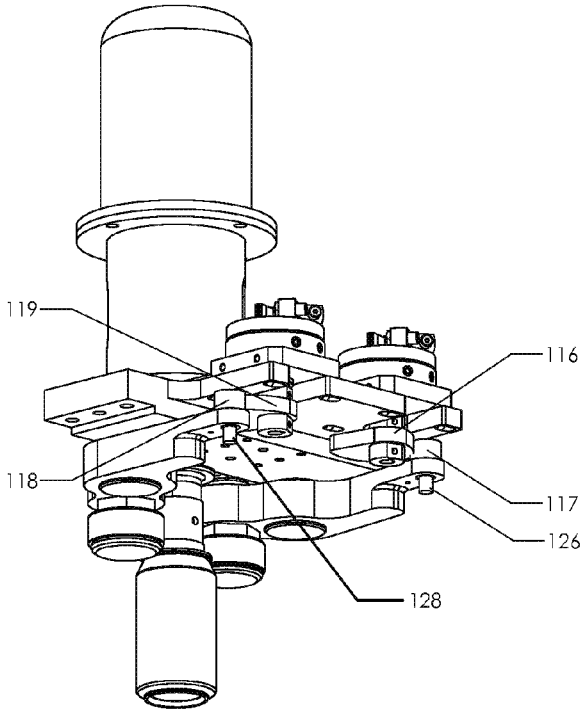
FIG. 7 is a perspective view of several components of a can seaming apparatus from a lower point of view.

FIG. 7 illustrates a perspective view from the lower vantage point of the seam producing apparatus, showing the driving cam 116 and corresponding cam follower 117 and the driving cam 119 and corresponding cam follower 118.

Figure 8:
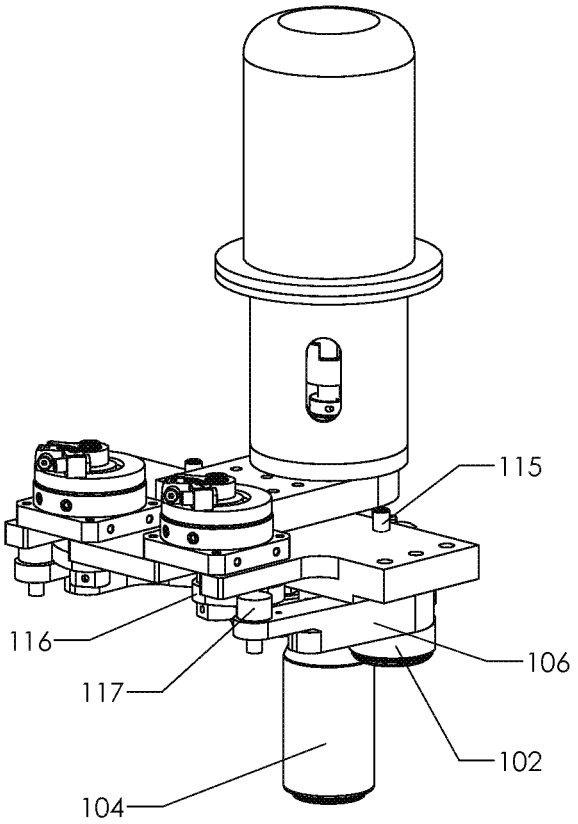
FIG. 8 is an additional view of a cam system of a can seaming apparatus from an upper and rear point of view.

FIG. 8 provides an additional view of the driving cam 116 and cam follower 117 connected to the seaming arm 106. In operation, the driving cam 116 rotates and the rotation is traced by the cam follower 117. With the cam follower 117 attached to the seaming arm 106, the tracing action causes the seaming arm 106 to pivot about the pivot 115. This repeatable and accurate action places a first seam roller 101 (not shown on FIG. 8) into contact with the seaming area 112 of the can/lid assembly 104. The second seam roller 102 is then put in contact with the seaming area 112 of the can/lid assembly 104 to complete a seam. The seaming arms 105, 106 may be provided to have carefully selected lengths, so that force is multiplied at the seam rollers 101, 102, thereby lessening radial forces on the cam followers 117, 118 and the driving cams 116, 119.

The adjustability of the driving cams 116, 119 attached to the rotary actuators 109, 110 in combination with the eccentric based cam followers 118, 117 make the final specifications of the produced seam controllable within the range of 0.001 inch, according to some embodiments. In other embodiments, the can seam is repeatable to within 0.003 inch.

Figure 9:
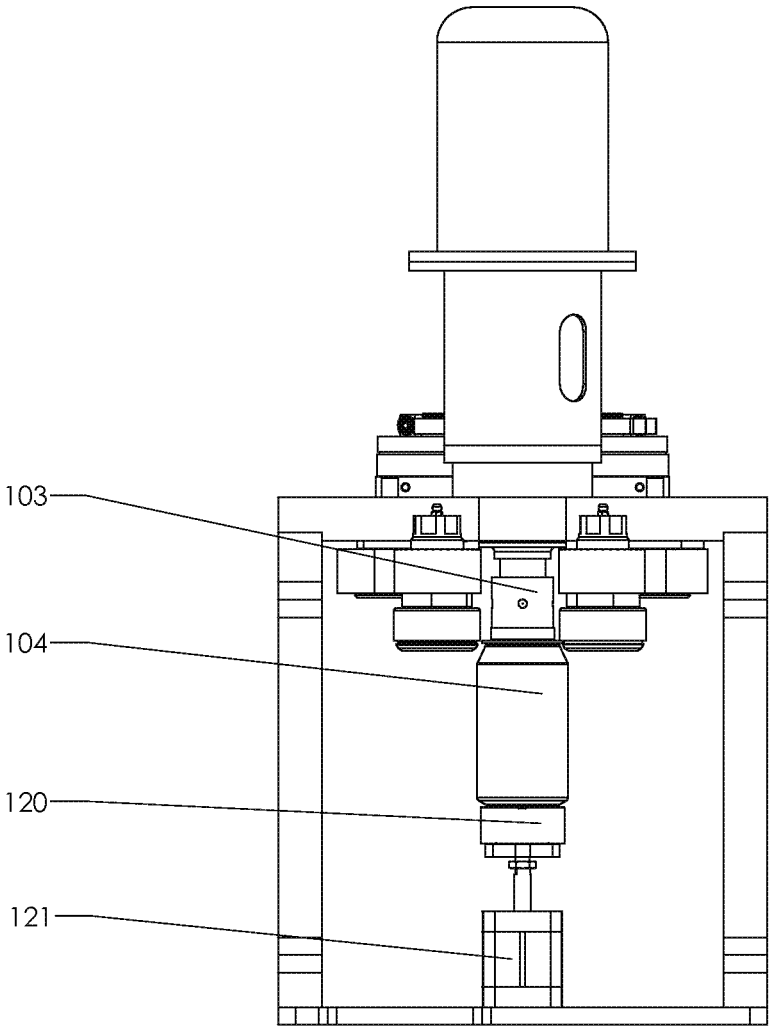
FIG. 9 is a front plan view of a can seaming apparatus and elevation device.

As shown in FIG. 9, the can seamer 100 may be implemented in conjunction with a can elevation device that raises a can/lid assembly 104 from the conveyor surface to engage the seaming chuck 103. The filled can/lid assembly 104 is required to rotate in concert with the rotating seaming chuck 103. The FIG. 9 can elevation device embodiment features a table 120 that engages the bottom of the filled can/lid assembly 104. Contained within the table 120 is a bearing (hidden) that allows the table 120 to follow the rotation of the seaming chuck 103. The can/lid assembly 104 located on the table 120 is raised by a pneumatic cylinder 121, or other lifting means. The pneumatic cylinder 121 is configured to bring the filled can/lid assembly 104 into engagement with the seaming chuck 103 prior to the full extension of the pneumatic cylinder. An externally controlled pressure source then allows the operator to produce an accurate axial force engaging the filled can/lid assembly 104 with the seaming chuck 103 which is useful for the accurate reproduction of the formed seam.

What is claimed is:

1. A can seaming apparatus comprising:

a seaming chuck providing for engagement with a can and lid assembly;

a motor engaged with the seaming chuck and providing for the rotation of the seaming chuck around a can axis at a selected rate of rotation;

a first seaming arm pivotably secured to a first pivot shaft;

a second seaming arm pivotably secured to a second pivot shaft;

a first seam roller attached to a first end of the first seaming arm;

a second seam roller attached to a first end of the second seaming arm;

a first cam system operatively associated with a second end of the first seaming arm, the first cam system comprising a first rotating cam, a first cam follower associated with the first rotating cam, and a first actuator which is physically separate from the motor and powered independent of the motor, the first actuator providing force to move the first seaming arm in a controlled fashion and thereby engage the first seam roller with the can and lid assembly; and a second cam system operatively associated with a second end of the second seaming arm, the second cam system comprising a second rotating cam, a second cam follower associated with the second rotating cam, and a second actuator which is physically separate from the motor and powered independent of the motor, and which is separate from the first actuator, the second actuator providing force to move the second seaming arm in a controlled fashion and thereby engage the second seam roller with the can and lid assembly, wherein the first actuator and the second actuator provide for primary lateral adjustment, perpendicular to the can axis, of the position of the first seam roller and the second seam roller, and wherein the first cam follower and the second cam follower comprise eccentric bases providing for secondary lateral adjustment, perpendicular to the can axis, of the first seam roller and the second seam roller, wherein the secondary lateral adjustment comprises a refinement of the primary lateral adjustment.

2. The can seaming apparatus of claim 1, wherein at least one of the first actuator and the second actuator comprises a pneumatic actuator.

3. The can seaming apparatus of claim 1, wherein at least one of the first actuator and the second actuator comprises an electric motor actuation device.

4. The can seaming apparatus of claim 1, wherein at least one of the first actuator and the second actuator is controlled with a programmable controller.

5. The can seaming apparatus of claim 1, further comprising:

one or more height adjustment devices attached to at least one the first seaming arm and the second seaming arm providing for the variable adjustment, parallel to the can axis, of the operational position of at least one of the first seam roller and the second seam roller.

6. The can seaming apparatus of claim 1, further comprising a can lifting device providing for the can and lid assembly to be lifted into contact with the seaming chuck.

7. A method for producing a seam on a can and lid assembly comprising:

providing a can seaming apparatus comprising:

a seaming chuck for engagement with a can and lid assembly;

a motor providing for the rotation of the seaming chuck around a can axis at a selected rate of rotation;

a first seaming arm pivotably secured to a first pivot shaft;

a second seaming arm pivotably secured to a second pivot shaft;

a first seam roller attached to a first end of the first seaming arm;

a second seam roller attached to a first end of the second seaming arm;

a first cam system operatively associated with a second end of the first seaming arm, the first cam system comprising a first rotating cam, a first cam follower associated with the first rotating cam, and a first actuator which is physically separate from the motor and powered independent of the motor; and a second cam system operatively associated with a second end of the second seaming arm, the second cam system comprising a second rotating cam, a second cam follower associated with the second rotating cam, and a second actuator which is physically separate from the motor and powered independent of the motor, and which is separate from the first actuator;

making a primary lateral adjustment of the lateral position, perpendicular to the can axis, of the first seam roller and the second seam roller by adjusting the position of the first actuator and the second actuator;

making a secondary lateral adjustment of the lateral position, perpendicular to the can axis, of the first seam roller and the second seam roller by adjusting the eccentric base of the first cam follower and the second cam follower, wherein the secondary lateral adjustment refines the primary lateral adjustment;

engaging a can and lid assembly with the seaming chuck;

rotating the seaming chuck and the engaged can and lid assembly around the can axis at a selected rate of rotation;

actuating the first cam system with the first actuator to move the first seaming arm in a controlled fashion and thereby engage the first seam roller with the can and lid assembly; and actuating the second cam system with the second actuator to move the second seaming arm in a controlled fashion and thereby engage the second seam roller with the can and lid assembly.

8. The method of claim 7, further comprising actuating one of the first cam system and the second cam system with a pneumatic actuator.

9. The method of claim 7, further comprising actuating one of the first cam system and the second cam system with an electric motor driven actuator.

10. The method of claim 7, further comprising controlling at least one of the first actuator and the second actuator with programmable controls.

11. The method of claim 7, further comprising adjusting the operational position, parallel to the can axis, of at least one of the first seam roller and the second seam roller with a height adjustment device attached to at least one of the first seaming arm and the second seaming arm.

12. The method of claim 7, further comprising raising the can and lid assembly into contact with the rotating seaming chuck using a can lifting device.

* * * * *